United States Patent [19]

Siozawa et al.

[11] 4,177,123

[45] Dec. 4, 1979

[54] METHOD FOR SUPPLYING BINDER INTO A COATING BATH AND ITS APPARATUS

[75] Inventors: Nobuo Siozawa; Uhee Kikuchi; Suguru Kimura, all of Sayama; Nobuaki Todoroki, Warabi; Jun-ichi Yasukawa, Chigasaki; Satoru Kamiyama, Tokyo, all of Japan

[73] Assignees: Taikisha Ltd.; Honda Motor Co., Ltd., both of Tokyo; Shinto Paint Co., Ltd., Amagasaki, all of Japan

[21] Appl. No.: 956,345

[22] Filed: Oct. 31, 1978

[51] Int. Cl.[2] ..... C25D 13/22; C25D 13/24

[52] U.S. Cl. ..... 204/181 C; 204/181 R; 204/181 N; 204/299 EC; 204/300 EC

[58] Field of Search ..... 204/181 R, 181 C, 299 EC, 204/300 EC

[56] References Cited

U.S. PATENT DOCUMENTS

| | | | |
|---|---|---|---|
| 3,499,828 | 3/1970 | De Vittorio | 204/299 EC |
| 3,663,399 | 5/1972 | Loop | 204/181 R |
| 3,869,366 | 3/1975 | Suzuki et al. | 204/181 C |

*Primary Examiner*—Howard S. Williams

*Attorney, Agent, or Firm*—Frishauf, Holtz, Goodman & Woodward

[57] ABSTRACT

A method for supplying binder into a coating tank for electrophoretic power coating comprises: a step for transferring into a solid/liquid separation tank a proper amount of plating bath liquid contained in the coating tank of which the binder component is reduced as a result of the work for coating a given number of articles; a step in which the plating bath liquid is left as it is so as to form supernatant liquid and residual liquid; a step for agitating the supernatant liquid in a supernatant tank; a step for returning the residual liquid to the coating tank; a step for supplying mother binder liquid corresponding in amount to the reduced binder component to a mixing tank; a step for transferring a given amount of the liquid in the supernatant liquid tank into the mixing tank; a step in which a proper amount of plating bath liquid in the coating tank is supplied into the mixing tank while being agitated to form replenisher or supplementary bath liquid; and a step for supplying the replenisher bath liquid into the coating tank. The method is realized by an apparatus of this invention for supplying binder into a coating tank for electrophoretic powder coating.

2 Claims, 1 Drawing Figure

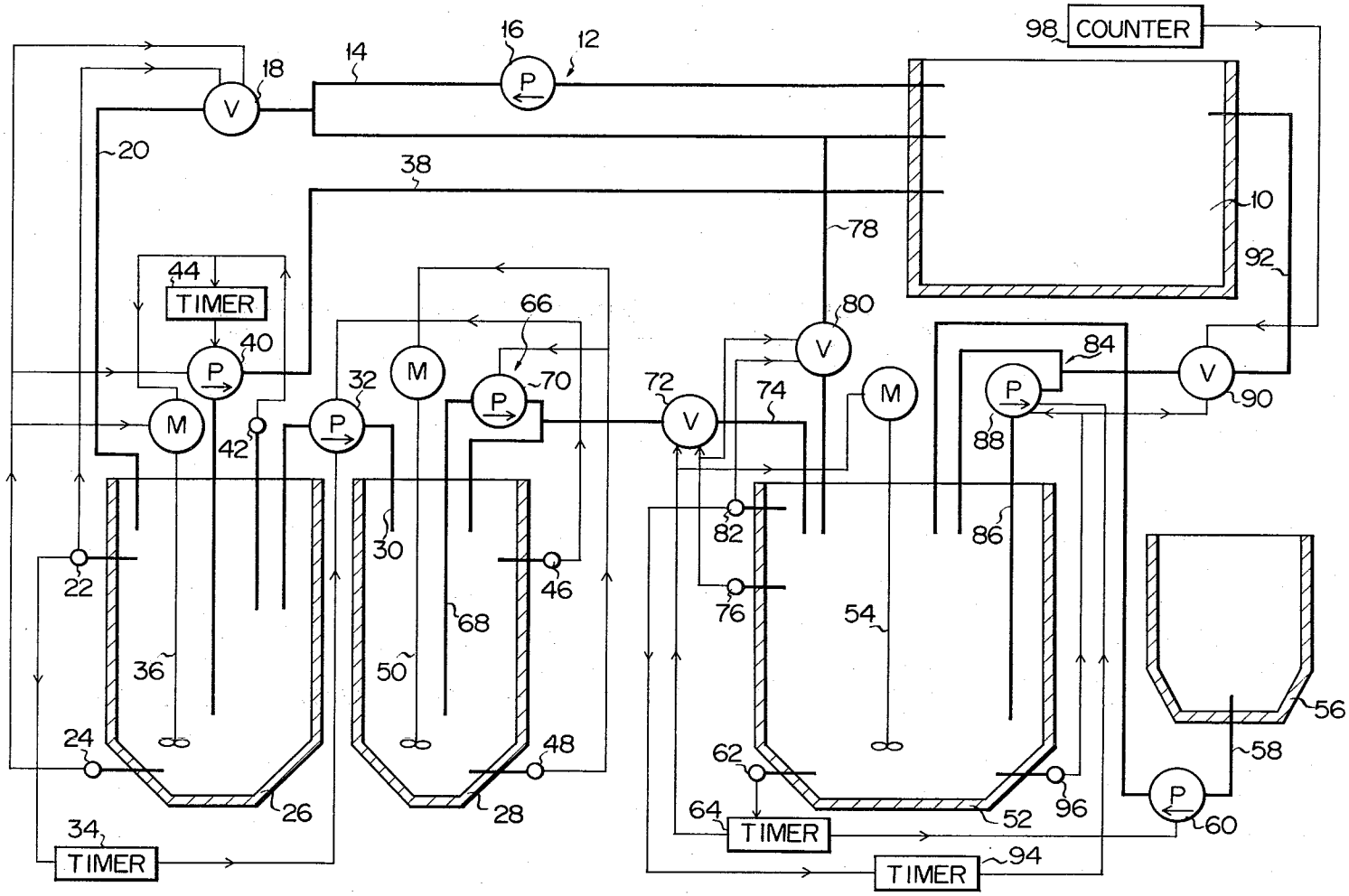
COUNTER
TIMER
TIMER
TIMER
TIMER
P
V
M

METHOD FOR SUPPLYING BINDER INTO A COATING BATH AND ITS APPARATUS

BACKGROUND OF THE INVENTION

The invention relates to a method for supplying binder into a coating tank for electrophoretic powder coating, and its apparatus.

Recently, an electrophoretic powder coating, which is generally called an EPC, has been developed and used widely. The EPC is of cationic type electrophoretic coating in which powder is used for the major component for layer formation and cataphoresis, electrolysis, electroendosmosis and electroextraction cooperate to form a coating layer on the surface of an article. The major difference of the EPC from the conventional anionic type electrophoretic coating is to use such a coating material in which insoluble powder is suspended in diluted solution of water soluble cationic binder and to apply a DC voltage in such a manner that an article dipped in plating bath liquid serves as a cathode and an electrode dipped in the same as an anode. Thus the coating layer formed on the surface of the article is composed of cationic binder and powder. The EPC has the following advantages: (i) The thick coating layer is formed for a relatively short time, e.g. for several seconds. (ii) The thickness of coating layer is easily adjustable. (iii) No elution of the metal from the article is occurs, because the coating is excuted by means of cationic type electrophoretic coating. (iv) The coating layer is excellent in tightness and corrosion proof. (v) Coating work is hygienic one with no harm by solvent and powder explosion by dust. (vi) Powder is collected almost completely.

In EPC, two coating components, i.e. cationic binder and powder, in the plating bath liquid are gradually consumed as the coating work progresses. The reduction of these components under a given value results in deterioration of coating quality. Therefore, the reduced component or components must be supplied in the course of coating work. The supply of the reduced component; however, encounters many problems and its operation is complex. For example, in the binder supply, mother binder liquid can not be directly mixed with the plating bath liquid. That is, if the mother binder liquid is directly poured into the bath liquid of which the powder concentration is about the low limit value ensuring proper mixing, the mother binder liquid is not uniformly dispersed into the bath liquid and thus the binder concentration becomes never uniform in the bath liquid.

Many attempts to solve such disadvantages have been made but the results of them have been all insufficient.

SUMMARY OF THE INVENTION

Accordingly, an object of the invention is to provide a method for supplying binder into a coating tank for electrophoretic powder coating in which, when the binder component consumed by coating work in the bath liquid is supplied into the bath liquid, binder is uniformly dispersed in the bath liquid without localizing the binder around a part of powder.

Another object of the invention is to provide apparatus for realizing the method.

According to one aspect of the invention, there is provided a method for supplying binder into a coating tank for electrophoretic powder coating comprising: a first step for transferring into a solid/liquid separation tank a proper amount of plating bath liquid contained in the coating tank of which the binder component is reduced as a result of the work for coating a given number of articles; a second step in which the bath liquid in the solid/liquid separation tank is left as it is for a given time period to permit a powder component in the bath liquid to precipitate so that the bath liquid is separated into the supernatant liquid with a powder component ratio substantially below a given value and the residual liquid; a third step in which the supernatant liquid in the solid/liquid separation tank is transferred into a supernatant liquid tank where it is reserved while being agitated; a fourth step in which the residual liquid in the solid/liquid separation tank is returned to the coating tank while being agitated; a fifth step in which mother binder liquid corresponding in amount to the reduced binder component is supplied from a mother liquid tank into a mixing tank; a sixth step in which, following the fifth step, a given amount of supernatant liquid is supplied from the supernatant liquid tank into the mixing tank where it is mixed with the mother binder liquid by agitating them; a seventh step in which, after the sixth step is completed, the plating bath liquid from the coating tank is supplied by a proper amount into the mixing tank while being agitated to prepare replenisher bath liquid; and an eighth step in which the replenisher bath liquid is supplied from the mixing tank into the coating tank to replenish the reduced binder component.

According to another aspect of the invention, there is provided an apparatus for supplying binder into a coating tank for electrophoretic powder coating comprising: means for taking out to the outside of the coating tank a proper amount of plating bath liquid of which the binder component is reduced as a result of the work coating a given number of articles; a solid/liquid separation tank for containing the bath liquid taken out by the taking-out means and in which the bath liquid is left as it is for a given time period to prepare supernatant liquid with a powder component substatially below a given value; a supernatant liquid tank which receives a given amount of the supernatant liquid from the solid/liquid separation tank and reserves the supernatant liquid while agitating the supernatant liquid; means for returning the residual liquid in the solid/liquid separation tank to the coating tank while agitating the residual liquid; a mixing tank provided with an agitator; an mother binder liquid tank for containing the mother binder liquid; means for supplying mother binder liquid corresponding in the amount to the reduced binder component into the mixing tank; means for supplying a given amount of supernatant liquid after the mother binder liquid is supplied from the supernatant liquid tank into the mixing tank while agitating; means for supplying a given amount of bath liquid from the coating tank into the mixing tank while agitating it, after the mother binder liquid and the supernatant liquid are mixed, to produce replenisher bath liquid; and supply means for supplying the replenisher bath liquid in the mixing tank into the coating tank to replenish the reduced binder component.

By using the above-mentioned method and apparatus, supply of binder to the bath liquid in a coating tank of which the binder is reduced, is excuted as described below.

(1) The bath liquid of which binder is reduced as a result of coating a given number of articles is taken out from the coating tank. The bath liquid taken out from the coating tank is left as it is for a given time period so that the powder component is precipitated to form the supernatant liquid with a low content of powder component.

(2) An amount of mother binder liquid with a high binder content is added to the supernatant liquid with a low binder content. The binder content of the mother binder liquid corresponds to the binder amount to be supplemented to the coating tank. The supernatant liquid and the mother binder liquid added are agitated and mixed. The mother binder liquid has a high concentration of powder but the supernatant liquid has a low powder content so that the mother binder liquid is not locally distributed with the powder and thus the binder and powder are substantially uniformly dispersed in the liquid i.e. medium mixture including the mother binder liquid and the supernatant liquid.

(3) The bath liquid coating in the coating tank is added to the medium mixture and is agitated and mixed, thereby to prepare the replenisher bath liquid to be supplied to the coating tank. The medium mixture includes much of binder, but it is substantially uniformly dispersed in the step of item (2) so that, in this step no localized concentration of the binder is produced in the replenisher bath liquid.

(4) The replenisher bath liquid is supplied to the coating tank and is agitated and mixed therein to prepare a bath liquid permitting a normal coating work. In this case, the replenisher bath liquid has a lower binder concentration than the medium mixture and the powder as well as the binder is uniformly dispersed in the replenisher bath liquid. Therefore, the replenisher bath liquid and the bath liquid in the coating tank may be easily and uniformly dispersed through agitation and mixing, without localized distribution of powder and binder.

Other objects and features of the invention will be apparent from the following description taken in connection with the accompanying drawing.

BRIEF DESCRIPTION OF THE DRAWING

The accompanying drawing shows a schematic diagram of an apparatus for supplying binder to a coating tank according to the invention, the diagram is also useful in explaining the method according to the invention.

DETAILED DESCRIPTION OF THE PREFERRED EMBODIMENT

Referring now to the drawing, reference numeral 10 designates a coating tank or main tank for electrophoretic powder coating. A proper amount of plating bath liquid (referred to as path liquid), which is contained in the main tank 10 and of which binder component is reduced as a result of coating work, is taken out from the main tank 10, through a duct line 12. The duct line 12 communicates at both ends with the main tank 10. A circulating path 14 for circulating the bath liquid is included in the duct line 12. A circulating pump 16 for circulating the bath liquid is provided on the circulating path 14. An automatic valve 18 coupled with the circulating path 14, when opened, guides the bath liquid from the circulating path 14 into a duct line 20 which in turn guides the bath liquid taken out through the automatic valve 18 into a solid/liquid separation tank 26. When the bath liquid falls below the lower limit level in the solid/liquid separation tank 26, a lower limit level detector 24, which is provided at the lower part of the tank 26, operates to produce an output signal toward the automatic valve 18. Upon receipt of the signal, the automatic valve 18 opens to permit the bath liquid to flow into the separation tank 26. When the bath liquid in the separation tank 26 increases to reach the upper limit level, an upper limit detector 22 produces an output signal which is sent to close the automatic valve 18. As the result, supply of the bath liquid to the separation tank 26 is stopped. The surface of the bath liquid in the tank 26 is not illustrated for simplicity of illustration. The omission of the bath liquid surface will similarly be applied to the illustration of the other tanks to be described later.

The bath liquid is supplied to the separation tank 26 up to the upper limit and then is left as it is for a given period of time. During this period, the powder component precipitates so that supernatant liquid with a powder mixing ratio approximate to a given value is formed in the upper part of the bath empirical and residual liquid containing much of powder is formed in the lower part. The time period is set up by a timer 34 which starts its operation in response to the output signal produced by the upper limit detector 22 when the bath liquid reaches the upper limit level. The time period is previously set up in an empirical manner.

After the time period, the timer produces an output signal which then drives the pump 32 so that the supernatant liquid in the separation tank 26 is transferred through a supernatant liquid supply duct 30 into an adjacent supernatant liquid tank 28. The supernatant liquid increases to reach the upper limit level and at this time a upper level detector 46 delivers an output signal which then stops the pump 32 and thus stop the supply of the supernatant liquid from the separation tank 26 to the supernatant liquid tank 28. In this manner, the supernatant liquid in the solid/liquid separation tank 26 is transferred into the supernatnt liquid tank 28 so that the supernatant liquid level descends to a given level. At this time, a lower limit level detector 42 produces an output signal by which an agitator 36 is driven to agitate the residual liquid in the solid/liquid separation tank 26. The output signal delivered from the level detector 42 to the agitator 36 is simultaneously applied through the timer 44 to a returning pump 40, after the time period set up by the timer. Then, the returning pump 40 transfers the residual liquid currently being agitated into the main tank 10 through a duct line 38. The operation of the returning pump 40 and the agitator 36 is stopped by an output signal produced from the lower limit detector 24 when the residual descends to reach the lower limit.

In this manner, the supernatant liquid is transferred from the solid/liquid separation tank into the supernatant liquid tank 28 up to the upper limit level. The tank 28 is provided with a lower limit detector 48 in addition to the upper limit detector 46. Only when the supernatant liquid is above the lower limit level, the lower limit detector 48 operates to produce an output signal for driving an agitator 50 and a circulating pump 70.

Reference numeral 66 designates a duct line for supplying the supernatant liquid from the supernatant tank 28 to a mixing tank 52. The duct line 66 communicating at both ends with the supernatant tank 28 through the circulating pump 70 including a circulating path 68 for circulating the supernatant liquid and a path 74 branched from the circulating path 68, supplies the supernatant liquid flowing through the circulating path into the mixing tank 52. An automatic valve 72 for opening and closing the path 74 is provided on the path 74.

A mother liquid tank 56 for storing mother binder liquid is capable of supplying the mother binder liquid into the mixing tank 52, through an mother liquid supply path 58 and a pump 60 provided on the path 58.

The mixing tank 52 mixes three kinds of liquids, i.e. mother binder liquid supplied from the tank 56, the supernatant liquid supplied from the tank 28, and the bath liquid containing the reduced amount of the binder component fed from the main tank 10. As the result of the mixing process, formed in replenisher bath liquid to be supplied to the main tank 10. The mixing tank 52 is provided with level detectors 62, 76, 82 and 96.

The level detector 62 produces an output signal when the liquid in the mixing tank 52 is below the lower limit level. The signal from the level detector 62 passes through a timer 64 to drive the pump 60. Response to the output signal from the detector 62, the pump 60 starts its operation and continues it for a time period determined up by the timer 64 to supply a given amount of mother binder liquid into the mixing tank 52. The amount of the mother binder liquid supplied corresponds to the amount of binder consumed in the main tank 10 and is determined depending on the number of the articles coated. This amount is also used to determine the time period set up by the timer 64.

In this way, after the time period, the timer 64 produces first to third output signals. As mentioned above, the first output signal stops the operation of the pump 60; the second output signal opens the automatic valve 72 provided on the supernatant liquid supply duct 66. Accordingly, the supernatant liquid in the supernatant tank 28 is supplied to the mixing tank 52, through the automatic valve 72. The third signal is applied to the agitator 54 which operates to agitate the liquid in the tank 52 when the liquid in the tank 52 is above the lower limit level. The agitator 54 first mixes the mother binder liquid with the supernatant liquid. When the liquid in the mixing tank 52 increases to reach a given level, a middle level detector 76 delivers an output signal to automatic valves 72 and 80. Until this time, the supernatant liquid has been supplied into the tank 52 by a proper amount for mixing it with the mother binder liquid which had been supplied into the mixing tank 52. The output signal from the middle level detector 76 closes the automatic valve 72 and the supply of the supernatant liquid into the mixing tank 52 is stopped while another automatic valve 80 is opened. The automatic valve 80 is provided on a bath supply duct 78 which is branched from the circulating path or duct 14 of the bath liquid take-out duct line 12 and supplies the bath liquid in the circulating path 14 into the mixing tank 52. Through this path, the bath liquid in the main tank 10 is supplied to the mixing tank 52 when the output signal is produced from the middle level detector 76. The bath liquid from the main tank 10 is added to the mixture of the mother binder liquid and the supernatant liquid while being agitated in the mixing tank 52. In this manner, the liquid in the tank 52 gradually increases to reach the upper limit level, and upon reaching the upper limit an upper limit detector 82 delivers an output signal to the automatic valve 80 and the timer 94. The output signal closes the automatic valve 80 to stop the supply of the bath liquid to the mixing tank 52 and at the same time to start the timer 94.

A bath liquid to be supplied in the coating tank 10 or a supply bath liquid mixed in the mixing tank 52 is supplied to the main tank 10 through a supply duct 84. The supply duct 84 communicates at both ends with the mixing tank 52. A circulating pump 88 is provided on a circulating path 86 for circulating the supply bath liquid in the mixing tank 52. A supply duct 82, which is branched from the circulating path 86, supplies the supply liquid in the circulating path into the main tank 10. An automatic valve 90 is inserted in the supply duct 92. When the liquid in the mixing tank 52 reaches the upper limit level, an upper limit detector 82 produces an output signal. The timer 94, upon receipt of the output signal from the detector 82, starts its operation and ceases it after a time period set therein. When ceasing the operation of the timer, the timer 94 produces an output signal which in turn drives the circulating pump 88. The period set up by the timer 94 is so selected that the liquids in the mixing tank 52 are sufficiently agitated by the agitator 54 to the uniformly mixed.

The coating work in the main tank 10 is progressed and a given amount of binder has been consumed in the bath liquid. At this time, it is necessary to supply into the main tank 10 the replenisher bath liquid containing much of binder which has been prepared in the mixing tank 52 by its necessary amount. The amount of the consumed binder is calculated from the number of articles coated in the main tank 10. Accordingly, the main tank 10 is provided with a counter 98 for counting the number of the coated articles. When the contents of the counter 98 reaches a given value, the counter 98 produces an output signal which in turn opens the automatic valve 90. Accordingly, the replenisher bath liquid circulating the circulating path 86 is supplied to the main tank 10. As a result, the level of the replenisher bath liquid in the mixing tank 52 decreases to the lower limit level. At this time, the lower limit detector 96 delivers an output signal to the circulating pump 88 and the automatic valve 90 so that the circulating pump 88 stops its operation and the automatic valve 90 is closed. The replenisher bath liquid is upplied into the main tank 10 with the amount equal to the volume defined by the levels detected by the upper and lower limit levels 82 and 96.

The operation of the binder supply apparatus thus far described will be given. Since the operations of the individual portions in the apparatus have been described, the description will be given by putting an emphasis on the overall operation of the apparatus.

After the counter 98, and timers 44, 34, 64 and 94 are all set, the binder supply apparatus is powered. Upon the powering, the circulating pump 16 in the bath liquid take-out duct 12 is given and a coating work is initiated in the main tank 10.

At this time, if the residual liquid in the solid/liquid separation tank 26 has come to the lower limit level, the lower limit detector 24 and the upper limit detector 22 operate to cause the automatic valve 18 to close or open, and the bath liquid in the main tank 10 is poured into the solid/liquid separation tank 26, while being agitated by the agitator 36, up to the lower limit level. The bath liquid transferred into the solid/liquid separation tank 26 is left for the time period set up by the timer 34 for which the bath liquid is separated into the supernatant liquid and the residual liquid. The supernatant liquid is then supplied into the supernatant liquid tank 28 by the pump 32, and when the surface of the supernatant liquid ascends to reach the upper limit level in the tank 28, the upper limit level detector 46 produces an output signal and the signal stops the supply of the supernatant liquid to the tank 28.

As a result of the supply of the supernatant liquid from the solid/liquid separation tank 26 to the supernatant liquid tank 28, a level of the supernatant liquid descends to the lower limit level in the tank 26. At this time, the level detector 42 produces an output signal. Upon receipt of the signal, the agitator 36 initiates its agitation of the residual liquid in the tank 26. The agitation continues for the time period set up by the timer 44. After the time period, the residual liquid well agitated is returned to the main tank 10 by the pump 40. When the level of the residual liquid reaches the lower limit of the solid/liquid separation tank 26, the agitator 36 and the returning pump 40 stop their operations and then the output signal from the lower limit detector 24 opens again the automatic valve 18. The result is that the bath liquid in the main tank 10 is again supplied to the separation tank 26 and this operation is repeated.

The supernatant liquid is supplied from the solid/liquid separation tank 26 to the supernatant liquid tank 28 by way of the supernatant liquid supply duct 30. The supply is performed from the lower limit up to the upper limit in the supernatant liquid tank 28 while being agitated by the agitator 50.

At this time, when the liquid in the mixing tank 52 has reached the lower limit level, the lower limit detector 62 produces an output signal which in turn drives the timer 64, and the pump 60. Following this, the pump 60 operates for the time period set up by the timer 64 to supply a given amount of the mother binder liquid into the mixing tank 52. After the time period, the timer produces an output signal which in turn opens the automatic valve 72 to permit the supernatant liquid circulating in the circulating path 68 of the duct line 66 to flow into the mixing tank 52. When the liquid in the tank 52 reaches to a given middle level, the middle level detector 76 produces an output signal. The signal closes the automatic valve 72 to terminate the supply of the supernatant liquid into the mixing tank 52.

The signal from the middle level detector 76 closes the automatic valve 72 while at the same time opens the automatic valve 80 so that the bath liquid circulating in the circulating path 14 of the duct 12 is supplied to the mixing tank 52. With the supply of the bath liquid, the liquid in the mixing tank 52 increases to reach to the upper limit level and at this time the level detector 82 produces an output signal by which the automatic valve 80 is closed. The liquid thus poured up to the upper level is uniformly agitated by the agitator 54 to form the replenisher bath liquid to be supplied to the main bath 10.

When the replenisher bath liquid reaches the upper limit in the mixing tank 52, the output signal produced from the level detector 82 drives the circulating pump 88 on the supply duct 84 after the time period set up by the timer 94, with the result that the replenisher bath liquid circulates in the circulating path 86.

In this manner, the replenisher bath liquid well agitated is prepared in the mixing tank 52. When a given number of articles are coated in the main tank 10 and the counter 98 counts the number to produce an output signal, the output signal opens the automatic valve 90 provided on the supply path 84 to permit the replenisher bath liquid in the tank 52 to the main tank 10. When the replenisher bath liquid is thus supplied and comes to the lower limit level in the mixing tank 52, the output signal derived from the detector 96 stops the supply of the replenisher bath liquid into the main tank 10. In this manner, the replenisher bath liquid is supplied into the main tank 10 by the amount corresponding to the volume defined by the upper and lower limit level. The amount of the mother binder liquid contained in the replenisher bath liquid corresponds to the mother binder liquid supplied from the tank 56 into the tank 52 for the time period set up by the timer 64 coupled with the level detector 62.

The amount of the binder consumed in the coating work is supplied to the main tank 10 through a series of operations mentioned above so that the bath liquid in the main tank 10 becomes appropriate to the electrophoretic powder coating.

What is claimed is:

1. A method for supplying binder into a coating tank for electrophoretic powder coating comprising:

a first step for transferring into a solid/liquid separation tank a proper amount of plating bath liquid contained in the coating tank of which the binder component is reduced as a result of the work for coating a given number of articles to be coated;

a second step in which the bath liquid in the solid/liquid separation tank is left as it is for a given time period to permit a powder component in the bath liquid to precipitate so that the bath liquid is separated into a supernatant liquid and a residual liquid, said supernatant liquid having a powder component ratio less than a given value;

a third step in which the supernatant liquid in the solid/liquid separation tank is transferred into a supernatant liquid tank where it is reserved while being agitated;

a fourth step in which the residual liquid in the solid/liquid separation tank is returned to the coating tank while being agitated;

a fifth step in which mother binder liquid corresponding in amount to the reduced binder component is supplied from a mother binder liquid tank into a mixing tank;

a sixth step in which, following the fifth step, a given amount of supernatant liquid is supplied from the supernatant liquid tank into the mixing tank where it is mixed with the mother binder liquid while being agitated;

a seventh step in which, after the sixth step is completed, the plating bath liquid from the coating tank is supplied by a proper amount into the mixing tank while being agitated, to produce replenisher bath liquid; and an eighth step in which the replenisher bath liquid is supplied from the mixing tank into the coating tank for replenishing the reduced binder component.

2. An apparatus for supplying binder into a coating tank for electrophoretic powder coating comprising:

means for taking out to the outside of the coating tank a proper amount of the plating bath liquid of which the binder component is reduced as a result of the work for coating a given number of articles to be coated in the coating tank;

a solid/liquid separation tank for containing the bath liquid taken out by said taking-out means and in which the bath liquid is left as it is for a given time period to prepare supernatant liquid and residual liquid, said supernatant liquid having a powder component ratio substantially below a given value;

a supernatant liquid tank which receives a given amount of the supernatant liquid from said solid/- liquid separation tank and reserves the supernatant liquid while agitating the supernatant liquid;

means for returning the residual liquid in said solid/-liquid separation tank to said coating tank while agitating the residual liquid;

a mixing tank provided with an agitator;

a mother binder liquid tank for containing mother binder liquid;

means for supplying the mother binder liquid of the amount corresponding to the reduced binder component into said mixing tank;

means for supplying a given amount of the supernatant liquid from said supernatant liquid tank into said mixing tank while agitating the supernatant liquid, after the mother binder liquid is supplied;

means for supplying a given amount of bath liquid from the coating tank into said mixing tank while agitating the bath liquid, after the mother binder liquid and the supernatant liquid are mixed, to produce replenisher bath liquid; and supply means for supplying the replenisher bath liquid in said mixing tank into the coating tank for supplementing the reduced binder component.

* * * * *